US009890729B2

(12) United States Patent
Tanaka et al.

(10) Patent No.: US 9,890,729 B2
(45) Date of Patent: Feb. 13, 2018

(54) FUEL INJECTION CONTROL UNIT

(71) Applicant: DENSO CORPORATION, Kariya, Aichi-pref. (JP)

(72) Inventors: Makoto Tanaka, Kariya (JP); Hiroaki Nagatomo, Kariya (JP)

(73) Assignee: DENSO CORPORATION, Kariya (JP)

( * ) Notice: Subject to any disclaimer, the term of this patent is extended or adjusted under 35 U.S.C. 154(b) by 121 days.

(21) Appl. No.: 15/030,442

(22) PCT Filed: Feb. 3, 2015

(86) PCT No.: PCT/JP2015/000461

§ 371 (c)(1),
(2) Date: Apr. 19, 2016

(87) PCT Pub. No.: WO2015/118854

PCT Pub. Date: Aug. 13, 2015

(65) Prior Publication Data

US 2016/0237935 A1 Aug. 18, 2016

(30) Foreign Application Priority Data

Feb. 10, 2014 (JP) ..... 2014-023756

(51) Int. Cl.
*F02D 41/00* (2006.01)
*F02D 41/20* (2006.01)
(Continued)

(52) U.S. Cl.
CPC ..... *F02D 41/20* (2013.01); *F02D 41/247* (2013.01); *F02M 45/12* (2013.01); *F02D 41/402* (2013.01);
(Continued)

(58) Field of Classification Search
CPC .... F02D 41/20; F02D 41/247; F02D 41/3011; F02D 41/3076
See application file for complete search history.

(56) References Cited

U.S. PATENT DOCUMENTS 9,714,626 B2 * 7/2017 Hatanaka ..... F02M 51/061
9,765,723 B2 * 9/2017 Imai ..... F02D 41/3845
(Continued)

FOREIGN PATENT DOCUMENTS

JP H09-195827 7/1997

*Primary Examiner* — Thomas Moulis
(74) *Attorney, Agent, or Firm* — Nixon & Vanderhye P.C.

(57) ABSTRACT

A fuel injection control unit includes an injection amount detector and a correction unit. When implementing partial lift injection where a valve closing operation is started after the valve body starts a valve opening operation and before a valve body reaches a maximum valve open position, the injection amount detector detects a physical quantity (valve closing timing) having a correlation with an injection amount. When implementing the partial lift injection, the correction unit corrects an energization time of a fuel injection valve on the basis of a detection value (learning value) that was previously detected by the injection amount detector. An energization time in a small amount region longer than a predetermined time in the partial lift injection is allowed to be corrected on the basis of a value (small amount time detection value) detected in the small amount region by the injection amount detector. On the other hand, an energization time in an extremely small amount region shorter than the predetermined time is prohibited from being corrected on the basis of the above small amount time detection value. As a result, a precision in the injection amount in the partial lift injection is improved.

5 Claims, 8 Drawing Sheets

(51) Int. Cl.
*F02D 41/24* (2006.01)
*F02M 45/12* (2006.01)
*F02D 41/40* (2006.01)

(52) U.S. Cl.
CPC ..... *F02D 2041/2055* (2013.01); *F02D 2200/0614* (2013.01)

(56) References Cited

U.S. PATENT DOCUMENTS

| | | | | |
|---|---|---|---|---|
| 2009/0014672 | A1* | 1/2009 | Schiemann | F01L 9/02 251/129.01 |
| 2009/0277423 | A1* | 11/2009 | Cooke | F02M 45/086 123/494 |
| 2012/0216783 | A1 | 8/2012 | Kusakabe et al. | |
| 2012/0318883 | A1 | 12/2012 | Kusakabe et al. | |
| 2014/0311459 | A1* | 10/2014 | Katsurahara | F02D 41/247 123/478 |
| 2016/0108857 | A1* | 4/2016 | Kanafani | F02M 21/06 123/294 |
| 2016/0252035 | A1* | 9/2016 | Katsurahara | F02D 41/20 123/478 |
| 2016/0281624 | A1* | 9/2016 | Dames | F02D 41/40 |
| 2017/0175653 | A1* | 6/2017 | Uchida | F02D 41/0002 |

* cited by examiner

| q (mm³) | | 1 | 2 | 3 | 4 | .... |
|---|---|---|---|---|---|---|
| Ti (ms) | (a) | 0.1 | 0.2 | 0.3 | 0.4 | .... |
| | (b) | 0.2 | 0.3 | 0.4 | 0.5 | .... |
| | (c) | 0.3 | 0.4 | 0.5 | 0.6 | .... |
| | (d) | 0.4 | 0.5 | 0.6 | 0.7 | .... |

LATE
VALVE CLOSING TIMING
EARLY

FUEL INJECTION CONTROL UNIT

CROSS-REFERENCE TO RELATED APPLICATIONS

This application is the U.S. national phase of International Application No. PCT/JP2015/000461 filed on Feb. 3, 2015 which designated the U.S. and claims priority to Japanese patent application No. 2014-23756 filed on Feb. 10, 2014 the entire contents of each of which are incorporated herein by reference.

TECHNICAL FIELD

The present disclosure relates to a fuel injection control unit that controls an energization time of a coil of a fuel injection valve to control the injection amount of a fuel.

BACKGROUND ART

In a conventional control device for controlling such a fuel injection valve, a map representing a relationship (Ti-q characteristic) between an energization time Ti of the coil and an injection amount q is stored in advance, and the energization time Ti corresponding to a required injection amount is calculated with reference to the map. In recent years, a minimum value of a controllable injection amount is required to be reduced as much as possible particularly in an internal combustion engine of a direct injection type.

Under the above circumstances, in the control device disclosed in Patent Literature 1, a partial lift injection where a valve closing operation is started before a valve body reaches a maximum valve open position from a start of a valve opening operation is implemented. With this operation, a minimum value of the injection amount can be reduced as compared with a control device that only performs a full lift injection where the valve closing operation is started after the valve body has reached the maximum valve open position.

PRIOR ART LITERATURE

Patent Literature

Patent Literature 1: JP 2013-2400A

SUMMARY OF THE INVENTION

According to the present inventors' study, since an electric resistance of the coil changes according to a temperature of the coil, an actual valve opening time relative to the energization time Ti changes according to the coil temperature. For that reason, a variation in a Ti-q characteristic is generated depending on the coil temperature. In a range of the partial lift injection of the Ti-q characteristic, the variation is greater than that in a range of the full lift injection. For that reason, in controlling the energization time Ti according to the map, the actual injection amount cannot be controlled with high precision during the partial lift injection.

The present disclosure aims at providing a fuel injection control unit that improves a precision of the injection amount in the partial lift injection.

One aspect of the present disclosure is a fuel injection control unit. The fuel injection control unit is applied to a fuel injection valve that injects a fuel used for combustion of an internal combustion engine by opening a valve body due to an electromagnetic attraction force generated by energization of a coil. Furthermore, the present disclosure includes a controller that controls the energization of the coil according to an energization time of the coil corresponding to a required value of an injection amount injected during opening of the valve body one time, an injection amount detector that detects a physical quantity having a correlation with the injection amount when implementing a partial lift injection where valve closing operation is started after the valve body starts valve opening operation and before the valve body reaches a maximum valve open position, and a correction unit that, when the partial lift injection is implemented, corrects the energization time on the basis of a detection value that was previously detected by the injection amount detector.

In the present disclosure, a small amount region is defined as a range of the energization time for which the partial lift injection is implemented and which is longer than a predetermined time, and an extremely small amount region is defined as a range of the energization time for which the partial lift injection is implemented and which is shorter than the predetermined time, the energization time in the small amount region is allowed to be corrected on the basis of the detection value in the small amount region, and the energization time in the extremely small amount region is prohibited from being corrected on the basis of the detection value in the small amount region.

According to the present disclosure, since the energization time in a small amount region is corrected on the basis of a detection value (small amount time detection value) in the small amount region, a precision in the injection amount in the small amount region can be improved. Since a correction in an extremely small amount region based on the small amount time detection value is prohibited, the injection amount precision in the extremely small amount region can be prevented from being degraded due to the correction.

EMBODIMENTS FOR CARRYING OUT INVENTION

Figure 1:
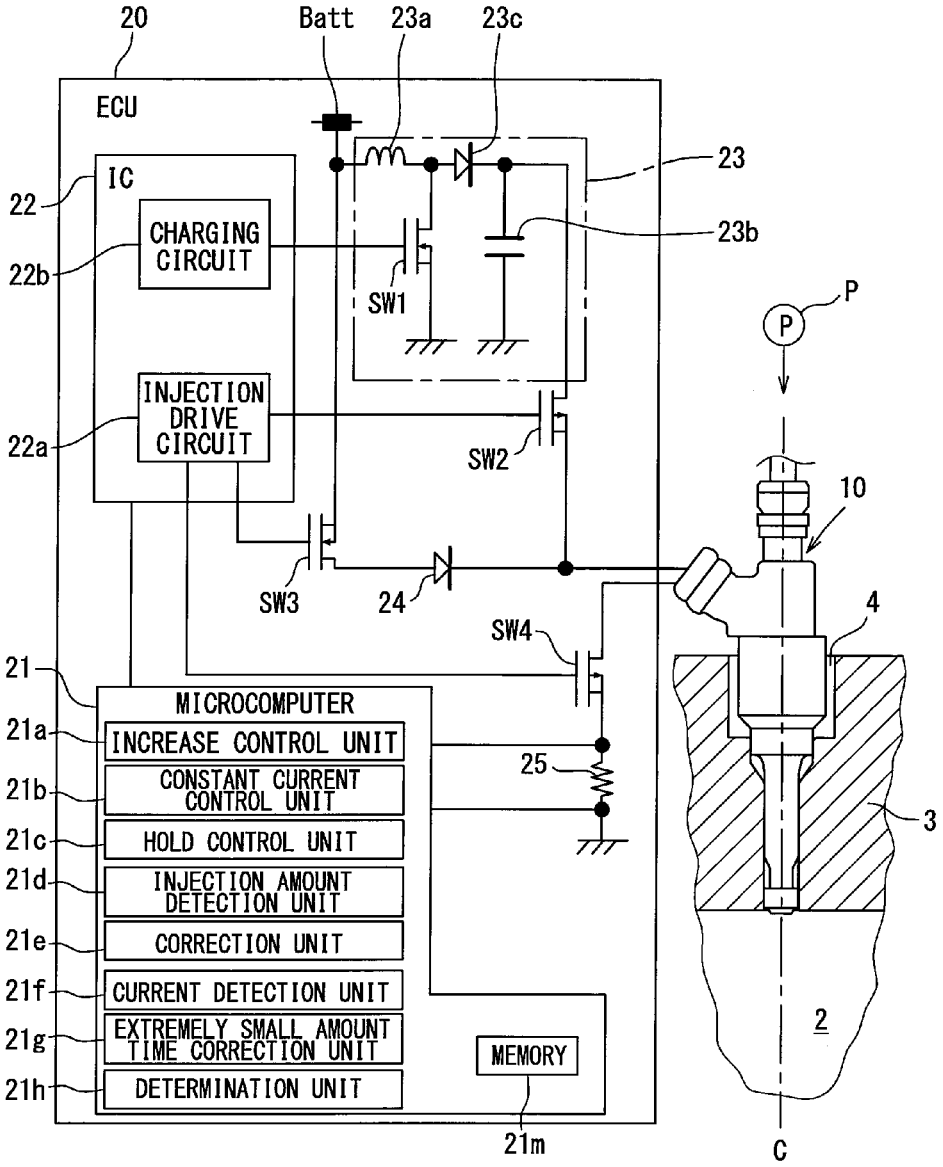
FIG. 1 is a schematic view illustrating a fuel injection control unit and a fuel injection system having the device according to a first embodiment of the present disclosure.

Hereinafter, multiple embodiments for carrying out the disclosure will be described with reference to the drawings. In the respective embodiments, a part that corresponds to a matter described in a preceding embodiment may be assigned the same reference numeral, and redundant explanation for the part may be omitted. When only a part of a configuration is described in the respective embodiments, another preceding embodiment may be applied to the other parts of the configuration.

The present inventors have studied that an actual injection amount is detected in advance when a partial lift injection is implemented, and when a subsequent partial lift injection is implemented, an energization time Ti is corrected on the basis of a result of the detection. According to the above configuration, an injection amount in the partial lift injection can be controlled with high precision.

However, the present inventors have found that the variation is generated in a range (small amount region) longer than a predetermined time in a partial lift injection period in a different manner from an extremely small amount region shorter than the predetermined time. In other words, the variation occurs so that an injection amount q increases as a coil temperature increases in a small amount region whereas the variation occurs so that the injection amount q decreases as the coil temperature increases in the extremely small amount region (refer to FIG. 4).

For that reason, when the actual injection amount (small amount time detection value) is detected, for example, with an injection time within the small amount region, and the energization time Ti in the extremely small amount region is corrected using the small amount time detection value, a precision in the injection amount may not be improved, and the precision may be rather deteriorated in some situations.

Under the circumstances, a fuel injection control unit that improves the precision in the injection amount in the partial lift injection will be described in the following embodiments.

First Embodiment

A fuel injection valve 10 illustrated in FIG. 1 is mounted in an ignition type internal combustion engine (gasoline engine), and injects a fuel directly into a combustion chamber 2 of the internal combustion engine. Specifically, a mounting hole 4 into which the fuel injection valve 10 is inserted is defined in a cylinder head 3 forming the combustion chamber 2. The fuel to be supplied to the fuel injection valve 10 is pumped by a fuel pump P, and the fuel pump P is driven by a rotational driving force of the internal combustion engine.

Figure 2:
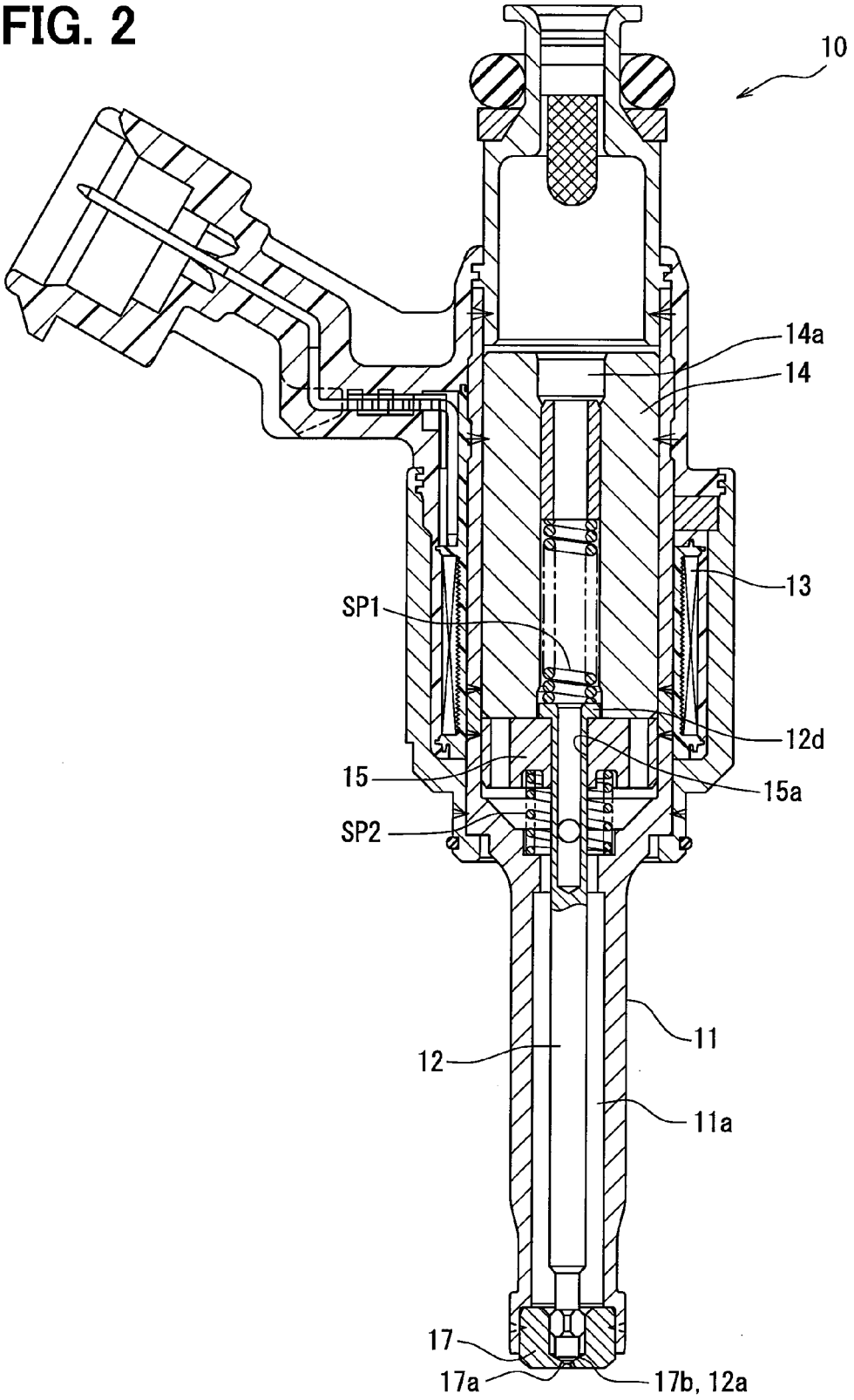
FIG. 2 is a cross-sectional view illustrating an overall fuel injection valve according to the first embodiment.

As illustrated in FIG. 2, the fuel injection valve 10 includes a body 11, a valve body 12, a coil 13, a fixed core 14, a movable core 15, and an injection hole body 17. The body 11 is made of a metal magnetic material so that a fuel passage 11*a* is defined inside. The body 11 houses the valve body 12, the fixed core 14, and the movable core 15 inside, and holds the injection hole body 17.

The injection hole body 17 is formed with a seating surface 17*b* on which the valve body 12 is seated or unseated, and an injection hole 17*a* through which the fuel is injected. When the valve body 12 performs the valve closing operation so that a seat surface 12*a* formed on the valve body 12 is seated on the seating surface 17*b*, the fuel injection from the injection hole 17*a* stops. When the valve body 12 performs the valve opening operation (is lifted up) so that the seat surface 12*a* is unseated from the seating surface 17*b*, the fuel is injected from the injection hole 17*a*.

The fixed core 14 is made of a metal magnetic material and formed into a cylindrical shape, and a fuel passage 14*a* is defined inside the cylinder. The movable core 15 is made of a metal magnetic material and formed into a disk shape. The movable core 15 is opposed to the fixed core 14 with a predetermined gap from the fixed core 14 when the coil 13 is unenergized. The fixed core 14 and the movable core 15 form a magnetic circuit that is a passage of a magnetic flux generated in the energization of the coil 13.

When the coil 13 is energized to generate an electromagnetic attraction force in the fixed core 14, the movable core 15 is sucked to the fixed core 14 due to the electromagnetic attraction force. As a result, the valve body 12 coupled with the movable core 15 is lifted up (performs the valve opening operation) against an elastic force and a fuel pressure valve closing force of a main spring SP1 which will be described later. On the other hand, when the energization of the coil 13 stops, the valve body 12 performs the valve closing operation together with the movable core 15 due to the elastic force of the main spring SP1.

A through-hole 15*a* is defined in the movable core 15, and the valve body 12 is inserted into the through-hole 15*a* in such a manner that the valve body 12 is slid and relatively movably assembled into the movable core 15. An engaging part 12*d* is formed on an end of the valve body 12 opposite to an injection hole side. When the movable core 15 is moved while being sucked to the fixed core 14, since the movable core 15 moves in a state where the engaging part 12*d* is locked to the movable core 15, the valve body 12 also moves (performs the valve opening operation) together with the movement of the movable core 15. Even in a state where the movable core 15 comes in contact with the fixed core 14, the valve body 12 can be moved relative to the movable core 15, and lifted up.

The main spring SP1 is arranged on a side of the valve body 12 opposite to the injection hole, and a sub-spring SP2 is disposed on an injection hole side of the movable core 15. Those springs SP1 and SP2 are coiled, and elastically deformed in a direction of a center axis C. The elastic force (main elastic force Fs1) of the main spring SP1 is given to the valve body 12 toward the valve close side. The elastic force (sub-elastic force Fs2) of the sub-spring SP2 is given to the movable core 15 toward the valve open side.

In short, the valve body 12 is sandwiched between the main spring SP1 and the seating surface 17*b*, and the movable core 15 is sandwiched between the sub-spring SP2 and the engaging part 12*d*. The elastic force Fs2 of the sub-spring SP2 is transmitted to the engaging part 12*d* through the movable core 15, and given to the valve body 12 in a valve opening direction. Therefore, an elastic force F2 into which the sub-elastic force Fs2 is subtracted from the main elastic force Fs1 is given to the valve body 12 in a valve closing direction.

Returning to the description of FIG. 1, an electronic control device (ECU 20) includes a microcomputer (microcomputer 21), an integrated circuit (IC 22), a booster circuit 23, and switching devices SW2, SW3, and SW4. The ECU 20 provides a fuel injection control unit that controls the operation of the fuel injection valve 10 to control a fuel injection amount. The ECU 20 and the fuel injection valve 10 provide a fuel injection system that injects an optimum amount of fuel.

The microcomputer 21 includes a central processing unit and a memory 21*m*, and calculates a target injection amount of the fuel and a target injection start timing on the basis of a load of the internal combustion engine and an engine rotational speed. The microcomputer 21 acquires an injection characteristic (Ti-q characteristic line) representing a relationship between an energization time Ti and an injection amount q through a test in advance, and controls the energization time Ti of the coil 13 according to the injection characteristic to control the injection amount q. A symbol t10 in FIG. 3(*a*) which will be described later indicates a start timing of the energization time, and a symbol t60 indicates an end timing of the energization time.

The IC 22 includes an injection drive circuit 22*a* that controls the operation of the switching devices SW2, SW3, and SW4, and a charging circuit 22*b* that controls the operation of the booster circuit 23. Those circuits 22*a* and 22*b* operate on the basis of an injection command signal output from the microcomputer 21. The injection command signal is a signal for commanding an energization state of the coil 13 of the fuel injection valve 10, and set by the microcomputer 21 on the basis of the target injection amount and the target injection start timing described above, and a coil current detection value 1 to be described later. The injection command signal includes an injection signal, a boost signal, and a battery signal which will be described later.

Figure 4:
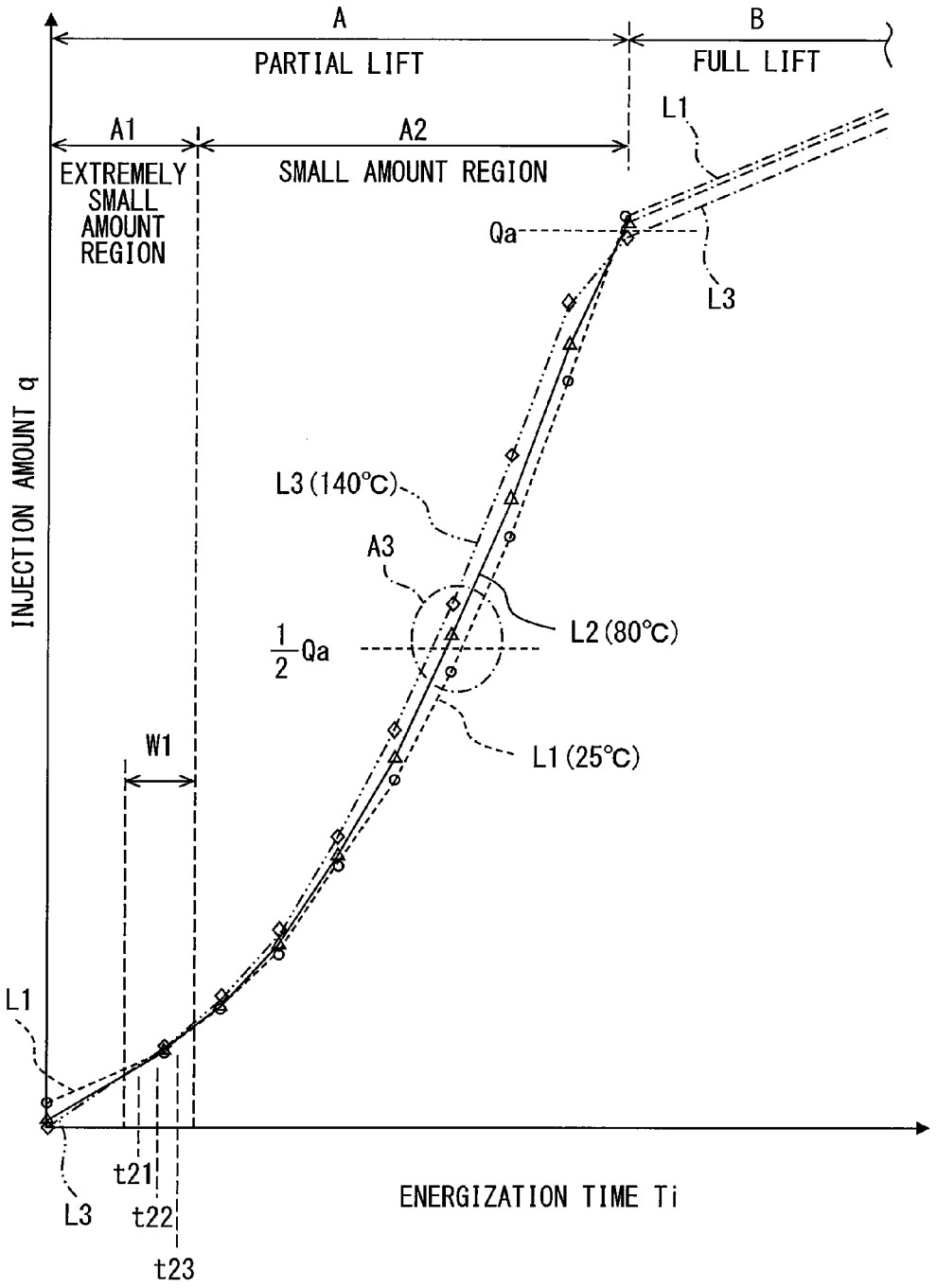
FIG. 4 is a graph showing that a characteristic line representing a relationship between an energization time and an injection amount is different in shape depending on a coil temperature.

The IC 22 provides "a control unit" that controls the energization of the coil 13 according to the energization time Ti corresponding to a required value of the injection amount on the basis of the Ti-q characteristic line (injection characteristic information) illustrated in FIG. 4.

The booster circuit 23 includes a coil 23*a*, a capacitor 23*b*, a diode 23*c*, and a switching device SW1. When the charging circuit 22*b* controls the switching device SW1 so that the switching device SW1 repeats on-operation and off-operation, a battery voltage to be applied from a battery terminal Batt is boosted (boosted) by the coil 23*a*, and the capacitor 23*b* is charged. The voltage of an electric power boosted and charged as described above corresponds to "boost voltage".

When the injection drive circuit 22*a* turns on both of the switching devices SW2 and SW4, the boost voltage is applied to the coil 13 of the fuel injection valve 10. On the other hand, when the injection drive circuit 22*a* performs switching operation to turn off the switching device SW2, and turn on the switching device SW3, the battery voltage is applied to the coil 13 of the fuel injection valve 10. When the voltage application to the coil 13 stops, the injection drive circuit 22*a* turns off the switching devices SW2, SW3, and SW4. A diode 24 prevents the boost voltage from being applied to the switching device SW3 at the time of turning on the switching device SW2.

A shunt resistor 25 detects a current flowing in the switching device SW4, that is, a current (coil current) flowing in the coil 13. The microcomputer 21 detects the coil current detection value 1 described above on the basis of a voltage drop amount generated in the shunt resistor 25.

Subsequently, a description will be given of the electromagnetic attraction force (valve opening force) generated by allowing the coil current to flow in detail.

The electromagnetic attraction force becomes larger as a magnetomotive force (ampere turn) generated in the fixed core 14 is larger. In other words, if the number of turns of the coil 13 is the same, the electromagnetic attraction force becomes larger as the coil current increases, and the ampere turn is larger. It takes time to saturate the suction force up to a maximum value since the energization starts. In this embodiment, the electromagnetic attraction force saturated up to the maximum value as described above is called "static suction force Fb".

The electromagnetic attraction force required when the valve body 12 starts the valve opening operation is called "necessary valve opening force Fa". The electromagnetic attraction force (necessary valve opening force) required when the valve body 12 starts the valve opening operation becomes larger as a pressure of the fuel to be supplied to the fuel injection valve 10 is higher. The necessary valve opening force becomes larger depending on various situations such that a viscosity of the fuel is large. Under the circumstances, the maximum value of the necessary valve opening force when a situation in which the necessary valve opening force becomes largest is assumed is defined as "necessary valve opening force Fa".

Figure 3:
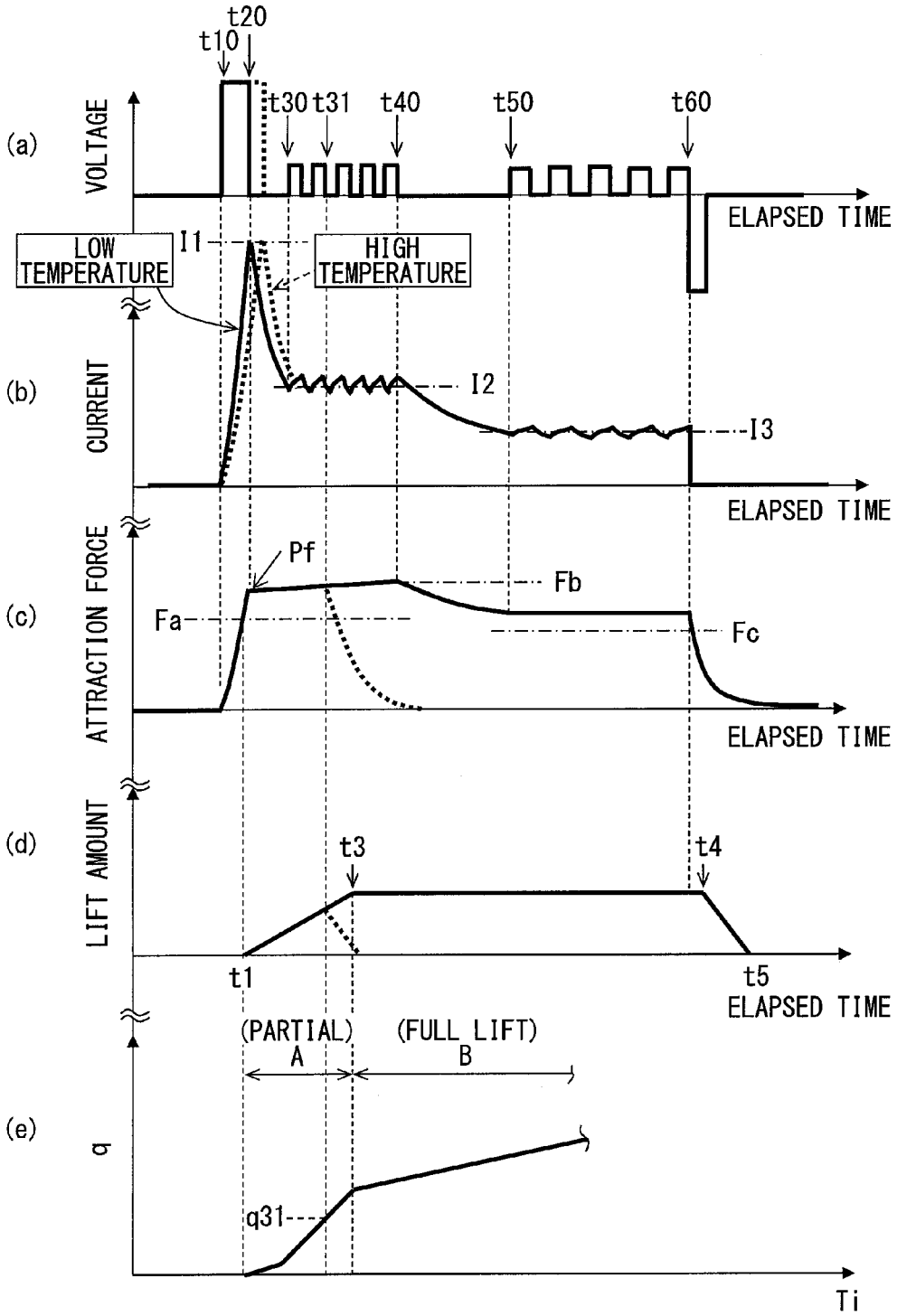
FIG. 3 illustrates graphs showing a change in a supply voltage to a coil, a coil current, an electromagnetic attraction force, and a lift amount with a time as well as a relationship between an energization time and an injection amount when an injection control is implemented according to the first embodiment.

FIG. 3(*a*) shows an applied voltage waveform to the coil 13 when the valve body 12 is opened once to implement the fuel injection. In each of FIGS. 3(*a*) and 3(*b*), a solid line indicates a waveform when the coil 13 is at room temperature, and a dotted line indicates a waveform when the coil 13 is at high temperature.

As shown in the figures, the boost voltage is applied to start the energization at a voltage application start timing (refer to t10) commanded by the injection command signal. Then, the coil current increases with the energization start (refer to FIG. 3(*b*)). The energization is turned off at a time point (refer to t20) when the coil current detection value I reaches a first target value I1 (refer to t20). In short, the coil current increases up to the first target value I1 by the boost voltage application caused by the first energization under the control. The microcomputer 21 that performs the control as described above corresponds to "increase control unit 21*a*". The first target value I1 corresponds to "predetermined threshold".

Thereafter, the energization by the battery voltage is controlled so that the coil current is maintained at a second target value I2 set to a value lower than the first target value I1. Specifically, the energization on/off caused by the battery voltage is repeated so that a deviation between the coil current detection value I and the second target value I2 falls within a predetermined width. As a result, a duty control is performed so that an average value of the fluctuating coil currents is held at the second target value I2. The microcomputer 21 that performs the above control corresponds to "constant current control unit 21*b*". The second target value I2 is set to such a value that the static suction force Fb is equal to or larger than the necessary valve opening force Fa.

Thereafter, the energization by the battery voltage is controlled so that the coil current is maintained at a third target value I3 set to a value lower than the second target value I2. Specifically, the energization on/off caused by the battery voltage is repeated so that a deviation between the coil current detection value 1 and the third target value I3 falls within a predetermined width. As a result, a duty control is performed so that an average value of the fluctuating coil currents is held at the third target value I3. The microcomputer 21 that performs the above control corresponds to "hold control unit 21*c*".

As illustrated in FIG. 3(*c*), the electromagnetic attraction force continues to increase in a period from the energization start time point, that is, the increase control start time point (t10) to the constant current control end time point (t40). The constant current control period is lower in the increase rate of the electromagnetic attraction force than the increase control period. The suction force is held at a predetermined value in a hold control period (t50 to t60). The third target value I3 is set so that the predetermined value becomes higher than a valve opening holding force Fc required to hold a valve open state. The valve opening holding force Fc is smaller than the necessary valve opening force Fa.

An injection signal included in the injection command signal is a pulse signal for commanding the energization time Ti, and a pulse-on timing is set to a timing (t10) earlier than the target injection start timing by a predetermined injection delay time. A pulse-off timing is set to an energization end timing (t60) when the energization time Ti is elapsed since the injection signal is pulsed on. The switching device SW4 operates according to the injection signal.

A boost signal included in the injection command signal is a pulse signal for commanding the energization on/off caused by the boost voltage, and pulsed on at the same time when the injection signal is pulsed on. Thereafter, the boost signal turns on in a period until the coil current detection value 1 reaches the first target value I1. As a result, the boost voltage is applied to the coil 13 in the increase control period.

A battery signal included in the injection command signal is pulsed on at a start time point t30 of the constant current control. Thereafter, the battery signal repeats on/off operation to perform a feedback control so that the coil current detection value 1 is held at the second target value I2 in a period until the elapsed time from the energization start reaches the predetermined time. Further, thereafter, the battery signal repeats the on/off operation to perform the feedback control so that the coil current detection value 1 is held at the third target value I3 in a period until the injection signal is pulsed off. The switching device SW3 operates according to the battery signal.

As illustrated in FIG. 3(*d*), the valve body 12 starts the valve opening operation at a time point when the injection delay time is elapsed from the energization start time point (t10), that is, at a time point t1 when the suction force reaches the necessary valve opening force Fa. A symbol t3 in the figure indicates a timing when the valve body 12 reaches a maximum valve open position (full lift position), and a symbol t4 in the figure indicates a timing when the valve body 12 starts to be closed. The valve body 12 starts to be closed at a time point when a delay time is elapsed from an energization end timing (t60), that is, at a time point t4 when the suction force decreases down to the valve opening holding force Fc.

In an example of FIG. 3(*a*), a voltage reversed in polarity is applied to the coil 13 at the same time as the injection end command timing. As a result, a coil current flows in a direction opposite to that of the coil current in the energization time Ti (t10 to t60), and the valve closing rate of the valve body 12 increases. In other words, the valve closing delay time since the energization end timing t60 till a time point t5 when the valve body 12 is seated and closed can be shortened. The reverse voltage application after the above energization end timing t60 is not included in the energization time Ti to be described later, and also not included in the energization time Ti of the Ti-q characteristic line.

FIG. 3(*e*) illustrates a characteristic line representing a relationship between the energization time Ti and the injection amount q, and illustrates the elapsed time and the energization time Ti in FIGS. 3(*a*) to 3(*d*) together. For example, a time point t31 (refer to FIG. 3(*a*)) at which the coil current is held at the second target value I2 is set to the end timing of the energization time, and the pulse of the injection signal is turned off. Then, as indicated by dotted lines in FIGS. 3(*c*) and 3(*d*), the suction force starts to decrease, and the valve body 12 starts to be closed at the time point t31. In that case, the injection amount is an injection amount q31 corresponding to t31 in the characteristic line illustrated in FIG. 3(*d*).

As illustrated in FIGS. 3(*d*) and 3(*e*), after the time point t3 when the valve body 12 reaches the maximum valve open position, an inclination of the Ti-q characteristic line is reduced. In the Ti-q characteristic line, a period between t1 and t3 is called "partial lift region A", and a period after t3 is called "full lift region B". In other words, in the partial lift region A, the valve body 12 starts the valve closing operation before reaching the maximum valve open position, and a small amount (refer to symbol q31) of fuel is injected.

When a temperature of the coil 13 is changed, a resistance value of the coil 13 is also changed, and therefore a shape of the Ti-q characteristic line is also changed. FIG. 4 illustrates a test result indicative of the shape of the Ti-q characteristic line which is changed according to the temperature. In the figure, a characteristic line L1 indicates a result tested at room temperature. A characteristic line L2 indicates a result tested by allowing a current to flow in the coil 13 through a resistor corresponding to 80° C. A characteristic line L3 indicates a test result when the current flows in the coil 13 through a resistor corresponding to 140° C.

The present inventors have obtained the following knowledge from the above test results. In a range of the energization time that is shorter than a peak emergence range W1, which will be described later, and that is within the partial lift region A, the injection amount to the energization time decreases as the coil temperature increases. On the other hand, in a range of the energization time that is longer than the peak emergence range W1 and that is within the partial lift region A, the injection amount to the energization time increases as the coil temperature increases.

In this embodiment, in the partial lift region A, the peak emergence range W1 and an energization time period shorter than the peak emergence range W1 are defined as an extremely small amount region A1. In the partial lift region A, a range except for the extremely small amount region A1, that is, an energization time period longer than the peak emergence range W1 is set as a small amount region A2. In other words, in the partial lift region A, a time range longer than a predetermined time is the small amount region A2, and a time range shorter than the predetermined time is the extremely small amount region A1. The predetermined time is set to a time equal to or longer than a time (current arrival time Ta) required to increase the current up to the first target value I1 (threshold). In more detail, the predetermined time is set to an upper limit (boundary on a longer time side) of the peak emergence range W1.

Figure 5:
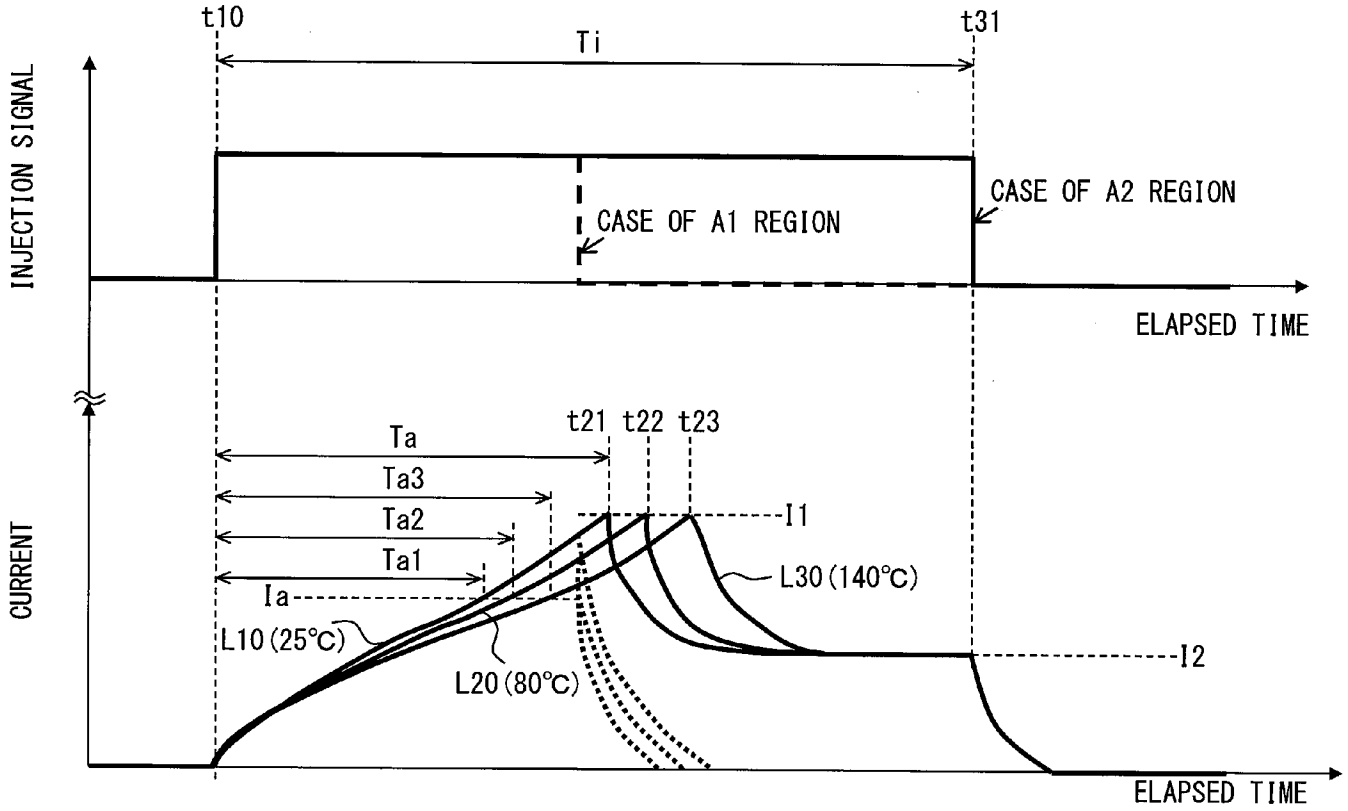
FIG. 5 is a graph showing that a current waveform representing a change in the coil current with a time is different in shape depending on the coil temperature.

Next, the peak emergence range W1 will be described. FIG. 5 illustrates a result obtained by testing and measuring a change (current waveform) in the coil current generated by the control of the increase control unit 21*a* and the constant current control unit 21*b*. In the test, the energization is terminated at the time point t31 when the coil current is held at the second target value I2 by the constant current control unit 21*b*, and set to the energization time Ti corresponding to the injection amount of the partial lift region A.

A current waveform L10 in the figure indicates a result tested at room temperature. A current waveform L20 indicates a test result obtained by allowing a current to flow in the coil 13 through a resistor corresponding to 80° C. A current waveform L30 indicates a test result when a current flows in the coil 13 through a resistor corresponding to 140° C. Symbols t21, t22, and t23 in the figure show timings at which the current becomes a peak value when the operation of the increase control unit 21*a* is terminated to stop the application of the boost voltage.

As illustrated in FIG. 5, a time until the current reaches the first target value I1 becomes longer as the coil temperature is higher, and an emergence timing of the peak value becomes later. This is attributed to a fact that the resistance of the coil 13 becomes higher as the coil temperature is higher. Therefore, when the energization is terminated before the emergence timings t21, t22, and t23 of the peak value, the injection amount to the energization time Ti is reduced more as the coil temperature is higher. That is, in the energization time Ti on a side shorter than the peak emergence range W1 in FIG. 4, the characteristic line L1 at a low temperature among the three characteristic lines L1, L2, and L3 is located above the characteristic line L3 at a high temperature.

However, when the energization is terminated after the emergence timings t21, t22, and t23 of the peak value in the partial lift region A, a total applied energy in a current supply period becomes high in the case of the current waveform L30 at a high temperature. For that reason, the suction force becomes larger, the actual lift amount of the valve body 12 becomes higher, and the injection amount becomes larger. On the contrary, in the case of the current waveform L10 at a low temperature, the total applied energy becomes lower in the current supply period. For that reason, the suction force becomes smaller, the actual lift amount of the valve body 12 becomes lower, and the injection amount becomes smaller.

That is, in a range on a side longer than the peak emergence range W1 in FIG. 4, the characteristic line L3 at the high temperature among the three characteristic lines L1, L2, and L3 is located above the characteristic line L1 at the low temperature. Therefore, the injection amount to the energization time increases more as the coil temperature is higher. On the other hand, in a range on a side shorter than the peak emergence range W1, the injection amount to the energization time decreases more as the coil temperature is higher. In other words, an increase or decrease in the injection amount to the energization time Ti depending on the temperature is switched with the peak emergence range W1 as a boundary.

As described above, the microcomputer 21 calculates the target injection amount on the basis of the engine rotational speed and the load, and calculates the energization time Ti corresponding to the target injection amount according to the Ti-q characteristic line. The energization time Ti is corrected as following according to a process of FIG. 6. In other words, the injection amount by the partial lift injection in the small amount region A2 is first detected, and an actual injection amount (small amount time detection value) which is the detection value of the injection amount is stored as a learning value. The microcomputer 21 that detects the actual injection amount as described above corresponds to "injection amount detector 21*d*". When implementing the partial lift injection in the small amount region A2, the microcomputer 21 allows the correction of the energization time Ti on the basis of a past detection value by the injection amount detector 21*d*. When implementing the partial lift injection in the small amount region A2, the microcomputer 21 corrects the energization time Ti on the basis of the detection value that was previously detected by the injection amount detector 21*d*. The microcomputer 21 that performs the correction as described above corresponds to "correction unit 21*e*".

On the other hand, when implementing the partial lift injection in the extremely small amount region A1, the microcomputer 21 prohibits the energization time Ti from being corrected on the basis of the small amount time detection value. As described above, the microcomputer 21 allows the correction of the energization time Ti based on the small amount time detection value when implementing the partial lift injection in the small amount region A2, and prohibits the correction of the energization time Ti based on the small amount time detection value when implementing the partial lift injection in the extremely small amount region A1. The microcomputer 21 in this case corresponds to "determination unit 21*h*". In other words, the determination unit 21*h* determines whether or not to allow the correction by the correction unit 21*e*. The microcomputer 21 detects, when implementing injection in the extremely small amount region A1, a current increase rate during an increase in the coil current by starting the energization of the coil 13. The microcomputer 21 that detects the current increase rate as described above corresponds to "current detector 21*f*". The microcomputer 21 corrects, when implementing injection in the extremely small amount region A1, the energization time Ti on the basis of the detected current increase rate. The microcomputer 21 that corrects the energization time Ti in the extremely small amount region A1 corresponds to "extremely small amount time correction unit 21*g*".

FIG. 6 is a flowchart illustrating a correction procedure of the energization time Ti described above, and a process of FIG. 6 is repetitively executed by the microcomputer 21 every time the energization time Ti corresponding to the target injection amount is calculated.

Figures 6, 7:
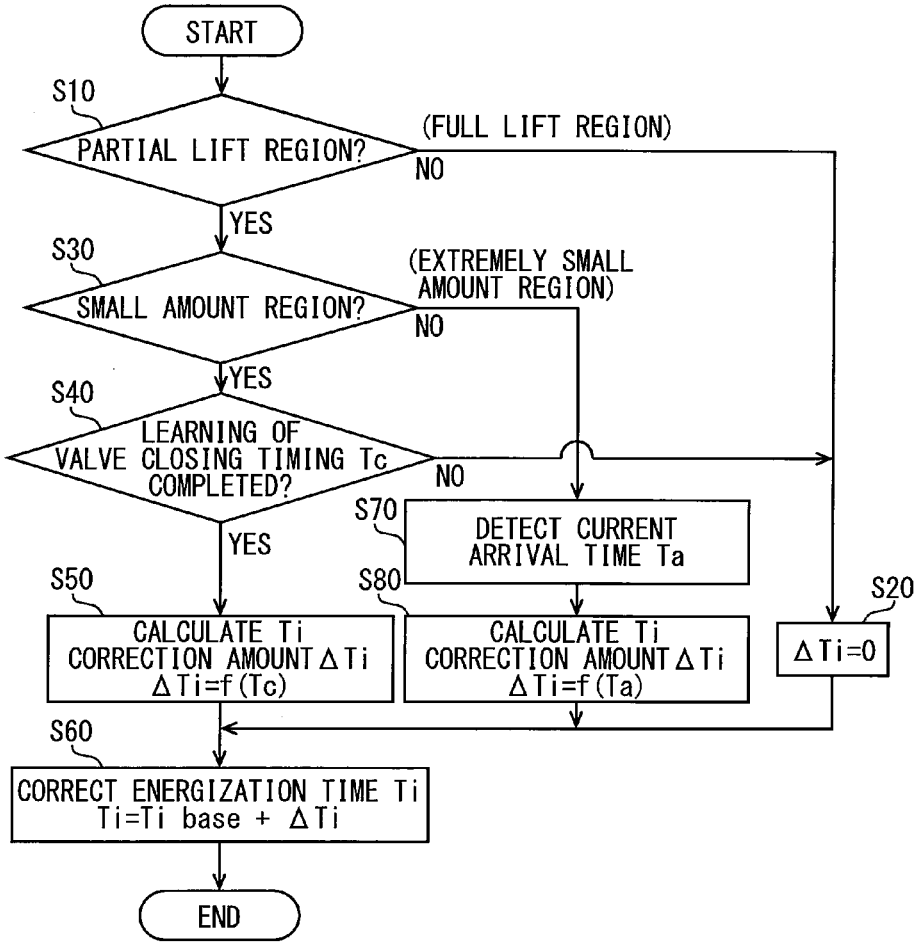
FIG. 6 is a flowchart illustrating a procedure for setting the energization time according to the first embodiment.
FIG. 7 is a diagram showing a map used for a correction of an energization time Ti when performing an injection in a small amount region.

First, in Step S10 of FIG. 6, it is determined whether the energization time Ti of the fuel injection to be implemented from now is in the partial lift region A or the full lift region B. If it is determined that the energization time Ti is in the full lift region B, the control proceeds to Step S20, and a correction amount ΔTi to the energization time Ti is set to zero. On the other hand, if it is determined that the energization time Ti is in the partial lift region A, the control proceeds to Step S30, and it is determined whether the energization time Ti is in the small amount region A2 or the extremely small amount region A1. If it is determined that the energization time Ti is in the small amount region A2, the control proceeds to Step S40, and it is determined whether the learning of a valve closing timing Tc of the valve body 12 has been completed, or not.

The learning will be described in detail. The valve closing timing Tc of the valve body 12 has a high correlation with the actual injection amount. In other words, since the actual valve opening time becomes longer as the valve closing timing Tc is later, the actual injection amount also becomes larger. Hence, if the valve closing timing Tc is detected, the actual injection amount can be estimated with high precision. The valve closing timing Tc can be detected, for example, on the basis of the current waveform illustrated in FIG. 3(*b*). Specifically, when the movement of the valve body 12 lifted down with the valve closing operation rapidly stops, an electromotive force is generated in the coil 13. As a result, pulsation emerges in the current waveform. Hence, with the detection of a timing at which the pulsation emerges in the current waveform, the valve closing timing Tc can be detected, and the actual injection amount can be further estimated.

The above learning is implemented in a process different from that in FIG. 6, and when the energization time Ti is a predetermined representative value, the actual injection amount at the time of injection by the representative value is estimated on the basis of the valve closing timing Tc. A difference between the estimated actual injection amount and the injection amount based on the Ti-q characteristic is stored as a learning value. In short, a change in the Ti-q characteristic caused by aging of the fuel injection valve 10 or the coil temperature is learned on the basis of the valve closing timing Tc. The energization time Ti corresponding to half the value of the injection amount Qa (refer to FIG. 4) in the boundary between the partial lift region A and the full lift region B is set as the above representative value. Specifically, as indicated by an alternate long and short dash line A3 in FIG. 4, the energization time Ti in the range where ½*Qa appears is set as the representative value.

Returning to the description of FIG. 6, if it is determined that the above learning is completed, the control proceeds to Step S50, and the correction amount ΔTi is calculated on the basis of the learning value. For example, the correction amount ΔTi is calculated according to a function with the valve closing timing Tc as a variable. In more detail, as illustrated in items (a), (b), (c), and (d) in FIG. 7, multiple tables of the energization time Ti to the injection amount q are stored in advance, and a table corresponding to the detected valve closing timing Tc is selected. The energization time Ti calculated on the basis of the selected table is a corrected value of the energization time Ti based on the Ti-q characteristic before learning. The table is selected so that the energization time Ti becomes shorter as the valve closing timing Tc is later.

In subsequent Step S60, the correction amount ΔTi calculated in Step S50 is calculated to a base value Tibase of the energization time Ti before correction which is calculated according to the Ti-q characteristic line to calculate the corrected energization time Ti. If it is determined that the learning is not completed in Step S10, the control proceeds to Step S20, and the correction amount ΔTi to the energization time Ti is set to zero, and the base value Tibase is set as the energization time Ti as it is in Step S60.

If it is determined in Step S30 that the energization time Ti is not in the small amount region A2, it is assumed that the energization time Ti is in the extremely small amount region A1, and the control proceeds to Step S70. In Step S70, the current arrival time Ta illustrated in FIG. 5 is detected. The current arrival time Ta is a time until the current passes through the threshold la from a time point t10 when the energization starts, and represents the increase rate of the current.

In the extremely small amount region A1, the current arrival time Ta has a high correlation with the actual injection amount. In other words, the current increase rate flowing into the coil 13 becomes lower as the current arrival time Ta is longer. As a result, an integral value (supply power amount) of the current becomes smaller, and the magnetic suction force exerted on the movable core 15 becomes smaller. For example, in the case of the current waveform L30 at the high temperature illustrated in FIG. 5, since the current increase rate is low, the current arrival time Ta3 is longer than the times Ta1 and Ta2 at the low temperature, as a result of which the integral value of the current becomes smaller. For that reason, since the magnetic suction force becomes smaller, the actual valve opening time becomes shorter, and the actual injection amount becomes smaller. Hence, in the extremely small amount region A1, if the current arrival time Ta is detected, the actual injection amount can be estimated with a high precision.

Figure 8:
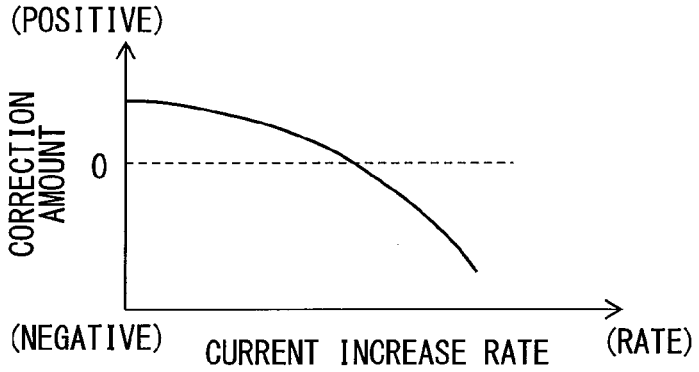
FIG. 8 is a diagram showing a map used for a correction of the energization time Ti when performing an injection in an extremely small amount region.

In subsequent Step S80, the correction amount ΔTi is calculated on the basis of the detected current arrival time Ta. For example, the correction amount ΔTi is calculated according to a function with the current arrival time Ta as a variable. In more detail, as illustrated in FIG. 8, the correction amount ΔTi is set to a larger value as the current increase rate is lower, that is, when the current arrival time Ta is longer. The correction amount ΔTi is added to the energization time Ti to correct the energization time Ti. With the above correction, the energization time Ti is corrected to be longer as the current arrival time Ta is longer. In subsequent Step S60, the correction amount ΔTi calculated in Step S80 is calculated to a base value Tibase of the energization time Ti before correction which is calculated according to the Ti-q characteristic line to calculate the corrected energization time Ti.

According to this embodiment as described above, the actual injection amount (small amount time detection value) when implementing the partial lift injection in the small amount region A2 is detected and learned. The microcomputer 21 (determination unit) allows the correction of the energization time Ti in the small amount region A2 on the basis of the learning value, and the correction unit 21*e* corrects the energization time Ti. For that reason, an improvement in the precision of the injection amount in the small amount region A2 can be performed. On the other hand, taking a fact that a different variation in the Ti-q characteristic is generated in the extremely small amount region A1 in a different manner from the small amount region A2 into account, the microcomputer 21 (determination unit) prohibits the correction of the energization time Ti in the extremely small amount region A1 based on the small amount time detection value. For that reason, a precision in the injection amount can be prevented from being degraded in the extremely small amount region by the correction.

Further, in this embodiment, in the partial lift region A, a time range longer than a predetermined time is called the small amount region A2, and a time range shorter than the predetermined time is called the extremely small amount region A1. The predetermined time is set to a time equal to or longer than a time (current arrival time Ta) required to increase the current to the first target value I1 (threshold).

According to the above configuration, a range in which the injection amount relative to the energization time decreases as the coil temperature increases is defined as the extremely small amount region A1, and a range in which the injection amount relative to the energization time increases as the coil temperature increases is defined as the small amount region A2. Hence, that the partial lift region A can be divided into two regions A1 and A2 that have different variations can be realized with a high precision. Hence, an effect obtained by implementing different corrections on the respective two regions A1 and A2 having different in variations is remarkably exhibited.

Further, this embodiment includes an extremely small amount time correction unit 21*g* that corrects the energization time Ti on the basis of the increase rate of the coil current at the time of implementing the partial lift injection in the extremely small amount region A1. For that reason, as compared with a case in which the energization time Ti in the extremely small amount region A1 is not corrected, a precision in the injection amount in the extremely small amount region A1 can be improved.

Further, in this embodiment, when correcting the energization time Ti, the injection amount injected with one representative value of the energization times Ti which is the partial lift injection in the small amount region A2 is learned.

Even when injection is performed in the energization time Ti other than the representative value, the energization time Ti is corrected on the basis of the injection amount (learning value) injected with the representative value. For that reason, as compared with a case in which the injection amounts are learned for each of the energization times Ti in the small amount region A2, many learning opportunities in the respective energization times Ti can be ensured, and thus a high learning precision can be ensured in a short learning period.

As indicated by the alternate long and short dash line A3 in FIG. 4, there is a tendency that the variation in the injection amount becomes largest in the vicinity of an injection pulse width which is the injection amount of ½ of an injection amount Qa corresponding to a boundary between the partial lift injection and the full lift injection. In this embodiment, taking the above into consideration, the representative value of the energization time Ti is set to the energization time Ti that is the injection amount of ½ of the injection amount Qa corresponding to the boundary between the partial lift injection and the full lift injection. For that reason, since the injection amount is detected with the injection pulse with which the variation of the injection amount has a maximum value, a detection error of the injection amount can be suppressed, and a precision in the correction of the energization time Ti in the small amount region A2 can be improved.

Second Embodiment

In the above embodiment illustrated in FIG. 6, when the fuel injection is performed in the extremely small amount region A1, the energization time Ti is corrected on the basis of the current arrival time Ta (current increase rate). On the contrary, in this embodiment, when the fuel injection is performed in the extremely small amount region A, the correction of the energization time Ti is not implemented.

Figure 9:
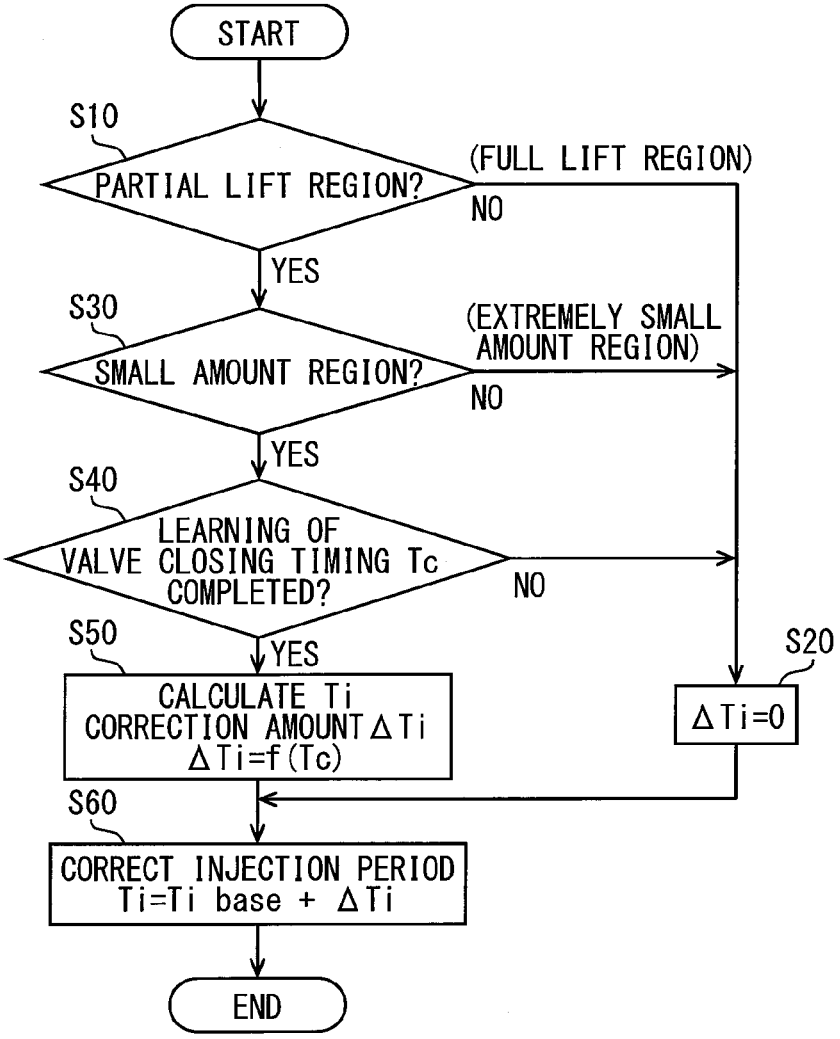
FIG. 9 is a flowchart illustrating a procedure for setting an energization time according to a second embodiment of the present disclosure.

In other words, as illustrated in FIG. 9, if it is determined in Step S30 that the injection amount is not in the small amount region A2 but in the extremely small amount region A1, the correction amount ΔTi is set to zero in Step S20 without implementing the detection of the current arrival time Ta (current increase rate). On the other hand, if it is determined in Step S30 that the injection amount is in the small amount region A2, the correction amount ΔTi is set on the basis of the learning value of the valve closing timing Tc (S50). The base value Tibase of the energization time Ti is corrected on the basis of the correction amount ΔTi (S60).

As described above, as in the above first embodiment, in this embodiment, the energization time Ti in the small amount region A2 is corrected on the basis of the small amount time detection value. For that reason, the precision in the injection amount in the small amount region A2 can be improved. On the other hand, in the energization time Ti in the extremely small amount region A1, a correction based on the small amount time detection value which has a different variation from the extremely small amount region A1 is prohibited. For that reason, a precision in the injection amount can be prevented from being degraded in the extremely small amount region by the correction.

As illustrated in FIG. 4, the variation in the extremely small amount region A1 in the Ti-q characteristic is smaller than the variation in the small amount region A2. For that reason, even when the correction in the extremely small amount region A1 is not implemented as in this embodiment, the precision in the injection amount in the extremely small amount region A1 is sufficiently ensured.

Third Embodiment

Figure 10:
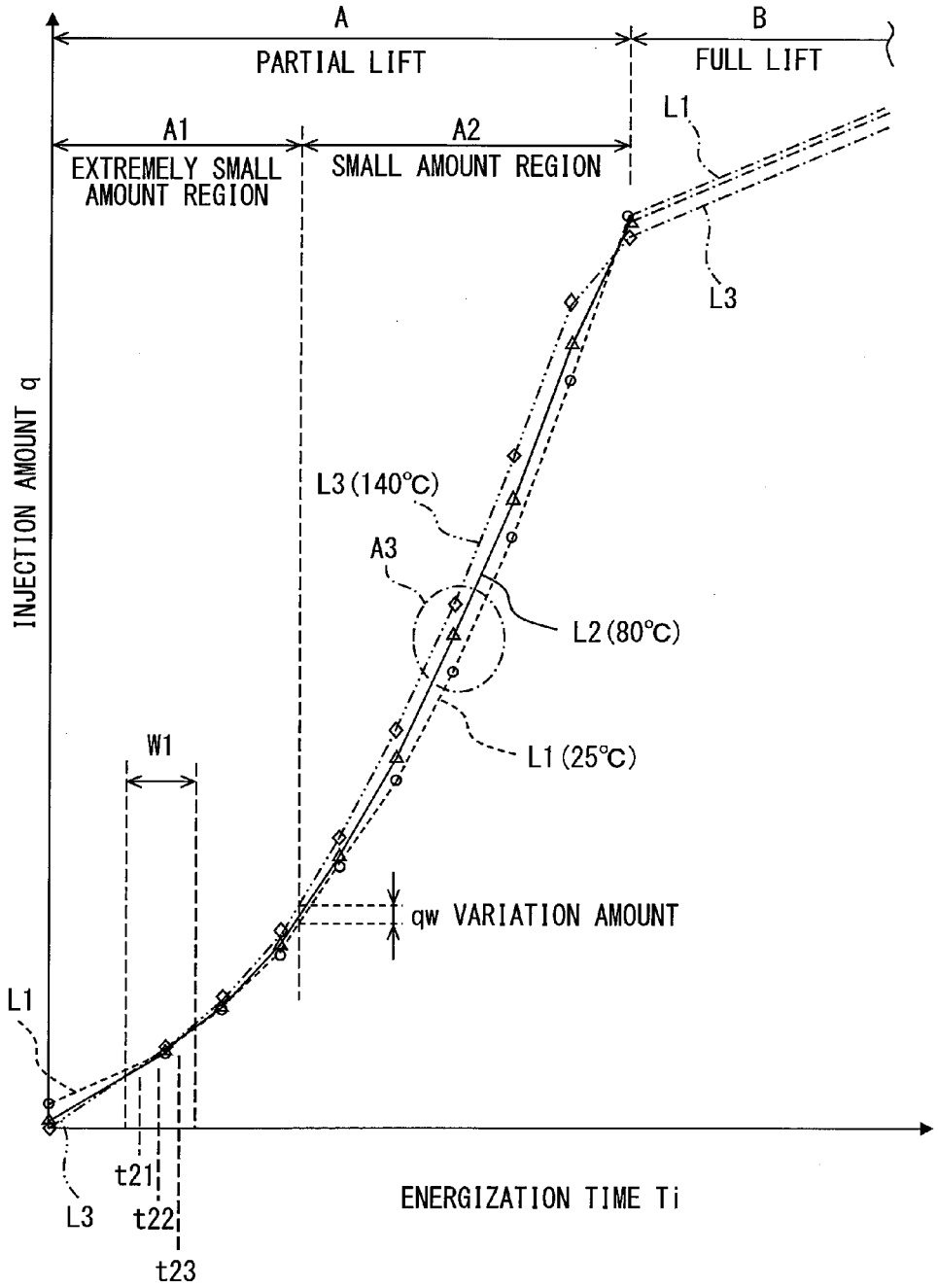
FIG. 10 is a diagram illustrating ranges of an extremely small amount region and a small amount region according to a third embodiment of the present disclosure.

In the embodiment shown in FIG. 4, a predetermined time that is a boundary between the extremely small amount region A1 and the small amount region A2 is set to an upper limit of the peak emergence range W1. On the contrary, in this embodiment, as illustrated in FIG. 10, a range in which the variation in the injection amount generated according to the use temperature of the coil 13 is smaller than a predetermined amount qw in the characteristic lines L1, L2, and L3 is set as the extremely small amount region A1. A range in which the variation is equal to or larger than the predetermined amount qw, that is, a range of an energization time longer than the extremely small amount region A1 is set as the small amount region A2. In other words, a predetermined time which is a boundary between the extremely small amount region A1 and the small amount region A2 is set to a time when the variation is the predetermined amount qw. In other words, the energization time Ti when a difference between the maximum injection amount q in the characteristic lines L1 to L3 and the minimum injection amount q in the characteristic lines L1 to L3 is the predetermined amount qw is set to the predetermined time which is the boundary between the extremely small amount region A1 and the small amount region A2. In the range in which the variation in the Ti-q characteristic (characteristic line) is small, when the energization time Ti is corrected on the basis of the past detection value by the injection amount detector 21*d*, an improvement in the injection amount precision by the correction is small. Yet, there is a risk that the detection error is present in the detection value by the injection amount detector 21*d*, and an improper correction is caused by the detection error. Hence, there is a high probability that the precision in the injection amount is rather degraded by correction.

Taking the above into consideration, in this embodiment, the range in which the variation in the injection amount is less than the predetermined amount qw is defined as the extremely small amount region A1, and when the partial lift injection in the extremely small amount region A1 is implemented, the energization time Ti is prohibited from being corrected on the basis of the small amount time detection value. In other words, the extremely small amount region A1 is defined as a range where the improvement in the precision by the correction is small and the risk in the detection error is likely to be significantly emerged. In such an extremely small amount region A1, since the correction based on the small amount time detection value is prohibited, the precision in the injection amount can be prevented from being rather degraded by the correction.

Other Embodiments

Hitherto, preferred embodiments of the present disclosure are described. However, the present disclosure is not limited to the above-described embodiments and may be variously changed and performed as exemplified below. In addition to combination of components for which enabling of specific combination is stated in each of the embodiments, the embodiments may be partially combined with each other even though no statement is present, particularly, as long as no problem in combination occurs.

The injection amount detector 21*d* illustrated in FIG. 1 detects the valve closing timing Tc on the basis of the current waveform illustrated in FIG. 3(*b*), and estimates the injection amount on the basis of the detected valve closing timing Tc. On the contrary, the lift amount of the valve body 12 may be detected by the lift sensor, and the injection amount may be estimated on the basis of the detection value. Alternatively, a pressure (in-cylinder pressure) in a combustion chamber of the internal combustion engine may be detected by an in-cylinder pressure sensor, and the injection amount may be estimated on the basis of the detection value. In short, as a specific example of a physical quantity having a correlation with the injection amount, there are the valve closing timing Tc as well as the lift amount and the in-cylinder pressure.

In the extremely small amount time correction unit 21*g* illustrated in FIG. 1, the energization time Ti in the extremely small amount region A1 is corrected on the basis of the increase rate of the coil current. The increase rate of the coil current is largely affected by the coil temperature. Specifically, since the coil resistance becomes larger as the coil temperature is higher, the increase rate of the coil current becomes lower. Taking the above into consideration, instead of the correction based on the increase rate of the coil current as described above, the temperature of the coil 13 may be detected, and the energization time Ti in the extremely small amount region A1 may be corrected on the basis of the detection value.

In the embodiments illustrated in FIGS. 6 and 9, the energization time Ti in the extremely small amount region A1 is corrected on the basis of the increase rate of the coil current. On the contrary, the actual injection amount (extremely small amount detection value) in the extremely small amount region A1 may be detected, and the energization time Ti in the extremely small amount region A1 may be corrected on the basis of the detection value. In short, the injection amounts are detected and learned in the extremely small amount region A1 and the small amount region A2, separately, and the respective energization times Ti in the extremely small amount region A1 and the small amount region A2 may be corrected with the use of the respective learning values.

In the embodiment illustrated in FIG. 1, the control unit that controls the energization of the coil 13 according to the energization time Ti responsive to the required value of the injection amount is realized by the IC 22. On the contrary, the control unit may be realized by the microcomputer 21. In other words, the switching devices SW1, SW2 and SW3 are not controlled by the IC 22, but may be controlled by the microcomputer 21.

In the embodiment illustrated in FIG. 3, the resistance value of the coil 13, the boost voltage, and the first target value I1 are set so that the peak emergence range W1 is located in the partial lift region A. On the contrary, the resistance value of the coil 13, the boost voltage, and the first target value I1 may be set so that the peak emergence range W1 is located in the full lift region B.

In the embodiment illustrated in FIG. 3, the energization is temporarily stopped at a time point (t20) when the coil current reaches the first target value I1, and thereafter the energization is restarted at a time point when the coil current is reduced to the second target value I2. Therefore, the time point (t20) when the coil current reaches the first target value I1 is a peak emergence timing. On the contrary, the boost voltage may be switched to the battery voltage at the time point when the coil current reaches the first target value I1 to continue the energization, and the increased coil current may be held at the first target value I1 for a predetermined time. In that case, a timing when the boost voltage is switched to the battery voltage corresponds to the peak emergence timing.

In the embodiment illustrated in FIG. 1, the fuel injection valve 10 is fitted to the cylinder head 3. However, the present disclosure may be applied to the fuel injection valve fitted to a cylinder block. The above embodiments are applied to the fuel injection valve 10 mounted in the internal combustion engine (gasoline engine) of the ignition type. However, the present disclosure may be applied to the fuel injection valve mounted in an internal combustion engine (diesel engine) of a compressed ignition type. Further, in the above embodiments, the above embodiments control the fuel injection valve for injecting the fuel directly into the combustion chamber 2, but the present disclosure may control the fuel injection valve for injecting the fuel into an intake pipe.

In the above embodiments, one microcomputer 22 provides the functions of the injection amount detector 21*d*, the correction unit 21*e*, the increase control unit 21*a*, the extremely small amount time correction unit 21*g*, and the determination unit 21*h*. However, those functions may be provided by multiple computers (microcomputers). Alternatively, those functions may be provided by not software, but hardware or the combination of the software and the hardware. For example, the above functions may be provided by an analog circuit.

The invention claimed is:

1. A fuel injection control unit applied to a fuel injection valve that injects a fuel used for combustion of an internal combustion engine by opening a valve body due to an electromagnetic attraction force generated by energization of a coil, the fuel injection control unit comprising:

a controller that controls the energization of the coil according to an energization time of the coil corresponding to a required value of an injection amount injected during opening of the valve body one time;

an injection amount detector that detects a physical quantity having a correlation with the injection amount when implementing a partial lift injection where valve closing operation is started after the valve body starts valve opening operation and before the valve body reaches a maximum valve open position; and a correction unit that, when the partial lift injection is implemented, corrects the energization time on the basis of a detection value that was previously detected by the injection amount detector, wherein a small amount region is defined as a range of the energization time for which the partial lift injection is implemented and which is longer than a predetermined time, and an extremely small amount region is defined as a range of the energization time for which the partial lift injection is implemented and which is shorter than the predetermined time, the energization time in the small amount region is allowed to be corrected on the basis of the detection value in the small amount region, and the energization time in the extremely small amount region is prohibited from being corrected on the basis of the detection value in the small amount region.

2. The fuel injection control unit according to claim 1, wherein the extremely small amount region is defined as a range during which, in a characteristic line representing a relationship between the energization time and the injection amount, a variation of the injection amount generated according to a temperature at which the coil is used becomes less than a predetermined amount.

3. The fuel injection control unit according to claim 1, further comprising:

a booster circuit that boosts a battery voltage; and an increase controller that applies a boost voltage boosted by the booster circuit to the coil when starting the energization time, the increase controller increasing a current flowing through the coil to a predetermined threshold value, wherein the predetermined time is set to a time equal to or longer than a time required to increase the current to the threshold value.

4. The fuel injection control unit according to claim 1, further comprising:

a current detector that detects a current increase rate during an increase in the current flowing through the coil when starting an energization of the coil; and an extremely small amount time correction unit that corrects the energization time on the basis of the detection value by the current detector when the partial lift injection is implemented in the extremely small amount region.

5. The fuel injection control unit according to claim 1, further comprising a determination unit that determines whether the energization time is allowed to be corrected by the correction unit, wherein the determination unit allows the energization time in the small amount region to be corrected on the basis of the detection value in the small amount region, and prohibits the energization time in the extremely small amount region from being corrected on the basis of the detection value in the small amount region.

* * * * *